US007621313B2

(12) United States Patent
Pham

(10) Patent No.: US 7,621,313 B2
(45) Date of Patent: Nov. 24, 2009

(54) PORTABLE ROLL UP WINDOW BLIND

(76) Inventor: Dung Viet Pham, 6785 Goldenhill Way, Mississauga, Ontario (CA) L5W 1P2

( * ) Notice: Subject to any disclaimer, the term of this patent is extended or adjusted under 35 U.S.C. 154(b) by 0 days.

(21) Appl. No.: 12/080,078

(22) Filed: Apr. 1, 2008

(65) Prior Publication Data

US 2009/0242143 A1 Oct. 1, 2009

(51) Int. Cl.
*A47G 5/02* (2006.01)
*A47H 1/00* (2006.01)

(52) U.S. Cl. ..... 160/250; 160/263; 160/323.1; 160/23.1

(58) Field of Classification Search ..... 160/19, 160/38, 39, 263, 211, 248, 260, 261, 262, 160/23.1, 24, 25; 248/261, 264, 265, 266, 248/252, 221.11, 222.13
See application file for complete search history.

(56) References Cited

U.S. PATENT DOCUMENTS 127,367 A * 5/1872 Pohl ..... 160/39
1,042,491 A * 10/1912 Smith ..... 160/121.1
1,253,486 A * 1/1918 Hammer ..... 211/105.4
1,350,221 A * 8/1920 Griffin ..... 248/252
1,911,749 A * 5/1933 Chambers ..... 160/39
2,032,842 A * 3/1936 Gould ..... 211/105.6
2,498,094 A * 2/1950 Plaum ..... 160/29
2,637,382 A * 5/1953 Nelson ..... 160/178.1 R
2,913,213 A * 11/1959 Folker ..... 248/265
2,929,444 A * 3/1960 Mahlouff ..... 160/28
3,110,506 A * 11/1963 O'Brien ..... 410/151
3,138,195 A * 6/1964 Cox ..... 160/39
3,203,468 A * 8/1965 Gossling et al. ..... 160/323.1
3,299,944 A * 1/1967 Gossling et al. ..... 160/263
3,372,728 A * 3/1968 Schaefer ..... 160/39
3,789,904 A * 2/1974 Takazawa ..... 160/120
3,965,960 A * 6/1976 Massey ..... 160/295
4,619,305 A * 10/1986 Comeau ..... 160/263
4,699,196 A * 10/1987 Elliott ..... 160/168.1 R
4,733,435 A * 3/1988 Darner ..... 16/87.4 R
4,744,471 A * 5/1988 Leister ..... 211/7
4,932,456 A * 6/1990 Buxbaum ..... 160/321

(Continued)

FOREIGN PATENT DOCUMENTS

IT TV 2005 000 169 * 7/2005

*Primary Examiner*—Katherine W Mitchell
*Assistant Examiner*—Jaime F Cardenas-Garcia
(74) *Attorney, Agent, or Firm*—David W. Wong

(57) ABSTRACT

A portable roll up window blind has an adjustable length and is removably mountable within the frame of a window. The blind has shell housing of an adjustable length and a telescopic winding core mounted between two end plates of the shell housing. One of the end plate is slidable and adjustable by a wedging means for pressing against the adjacent side wall of the window frame so that the two end plates cooperate with one another to secure the blind at a selected position in the window frame. The window blind panels are wound on the winding core in an overlapping manner. The winding core has one end engage with a round support pin located on the inner surface of the one end plate, and the other end engaged with a rotary shaft having a multi-sided cross sectional shape. The rotary shaft is rotatable by a pull chain for raising or lowering the window blind panels.

9 Claims, 4 Drawing Sheets

U.S. PATENT DOCUMENTS 5,203,393 A * 4/1993 Blevins et al. ..... 160/67
5,597,025 A * 1/1997 Forkner ..... 160/38
6,006,809 A * 12/1999 Williams et al. ..... 160/46
6,192,962 B1 * 2/2001 Glover ..... 160/126
6,460,593 B1 * 10/2002 Floyd ..... 160/370.22
6,463,984 B2 * 10/2002 Glover ..... 160/39
6,648,046 B1 * 11/2003 Gibson ..... 160/39
6,817,402 B1 * 11/2004 Fraczek et al. ..... 160/323.1
2001/0008176 A1 * 7/2001 Glover ..... 160/126
2003/0234087 A1 * 12/2003 Jones ..... 160/241
2006/0108078 A1 * 5/2006 Kollman et al. ..... 160/178.1 R
2008/0121353 A1 * 5/2008 Detmer et al. ..... 160/266
2008/0245486 A1 * 10/2008 Brown ..... 160/84.01
2008/0245940 A1 * 10/2008 Brown ..... 248/251
2008/0257504 A1 * 10/2008 Marchetto et al. ..... 160/311

* cited by examiner

PORTABLE ROLL UP WINDOW BLIND

BACKGROUND OF THE INVENTION

1. Field of Invention

This invention relates to a portable window blind which may be removably mounted in a window and more particularly relates to a roll up window blind which is adjustable in length for removably mounting in a window frame.

2. Background Art

Heretofore window blinds are fixedly mounted in a window frame or on the wall adjacent to a window with brackets or similar hardware. Although the window blind may be removed from the mounting brackets for cleaning, repair or replacement purposes; however, the mounting brackets or hardware are not intended to be removed, and they require drilling of openings and/or screw anchors in the window frame or the neighboring wall area for their securement. If the mounting hardware is removed, the openings and marks made by the brackets and anchors would remain as damage marks on the window frame or the neighboring wall area. For a temporary or transient resident such as a renter or a student staying at a dwelling or school residence, commonly they are not permitted by the landlord or the school residence rules to damage or deface the walls of a room in the dwelling or residence. Therefore, it is problematic for such persons to install a window blind on a window for privacy requirement.

Moreover, window blinds are of fixed length designed for covering windows of particular widths. For a renter or temporary resident who may have to move frequently it becomes economically unfeasible and wasteful in having to purchase new window blinds every time when moving, and the windows in the new residence have different widths than those in the previous residence even if the resident is permitted to install the blinds on the new windows with permanent means.

SUMMARY OF THE INVENTION

It is a principal object of the present invention to provide a portable window blind which may be securely and removably mounted to a window to provide privacy.

It is another object of the present invention to provide a portable window blind which may be mounted securely to a window frame without causing damage marks to the latter.

It is another object of the present invention to provide a window blind having an adjustable length variable for mounting to windows of various widths.

It is another object of the present invention to provide a window blind which is mountable at a selected height in a window frame.

It is yet another object of the present invention to provide a window blind which is simple in construction and easy to operate.

BRIEF DESCRIPTION OF THE DRAWINGS

Other objects and advantages of the present invention will become apparent from the following detailed description of the preferred embodiments thereof in connection with the accompanying drawings in which.

DETAILED DESCRIPTION OF THE PREFERRED EMBODIMENTS

Figure 1:
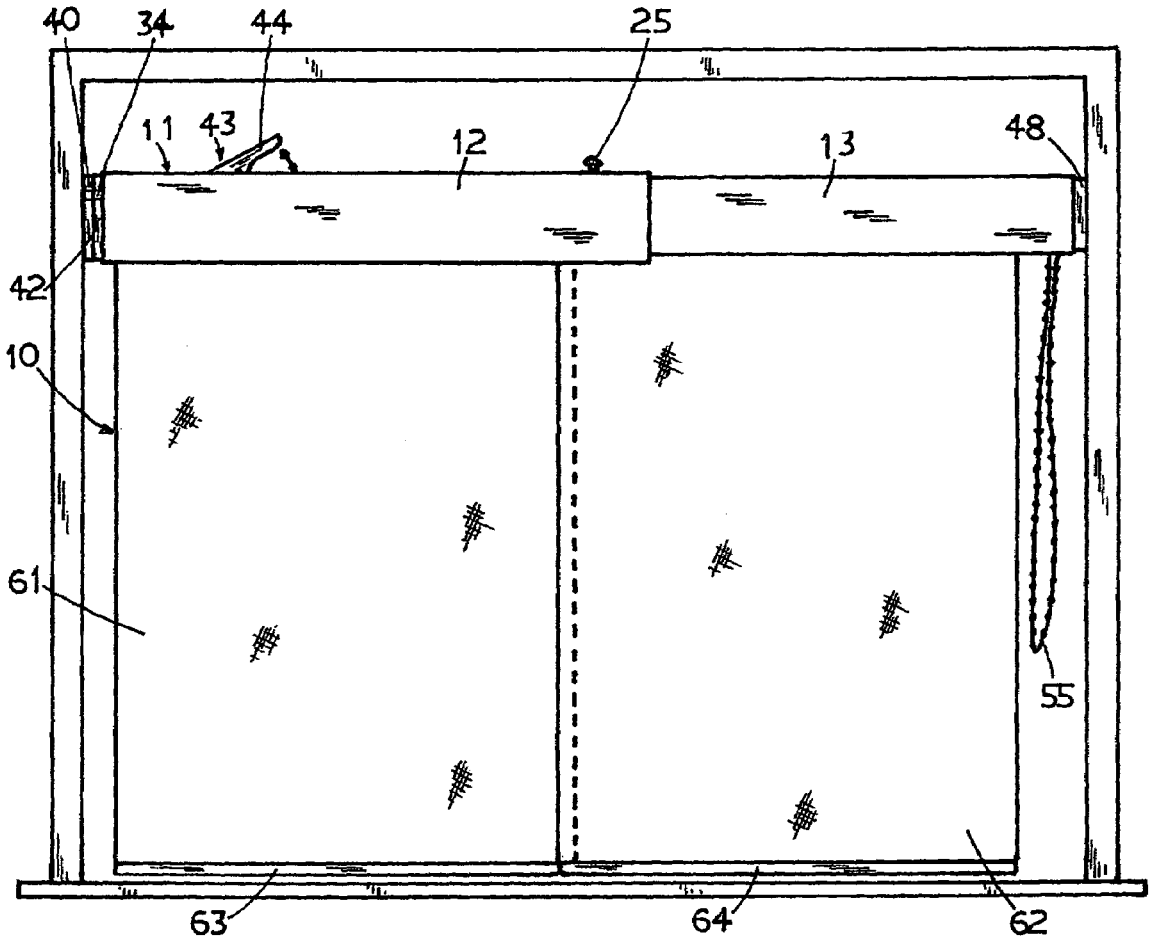
FIG. 1 is a perspective front elevation view of the portable window blind mounted in a window frame according to the present invention.
Figure 2:
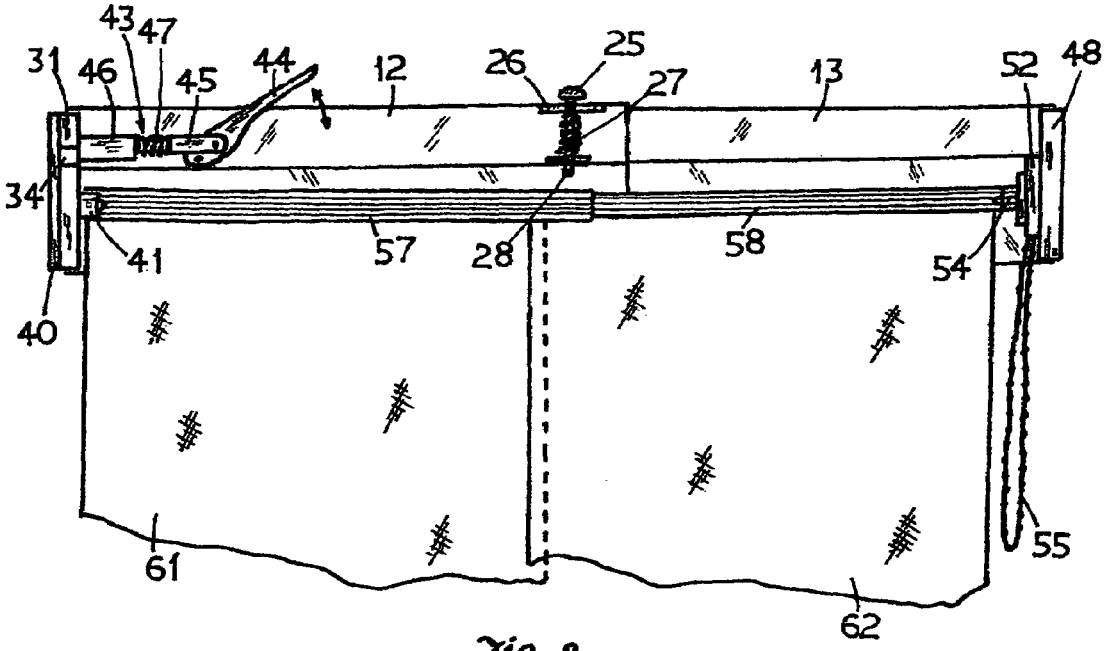
FIG. 2 is a partial sectional front view showing the internal structure of the portable window blind of the present invention.
Figure 3:
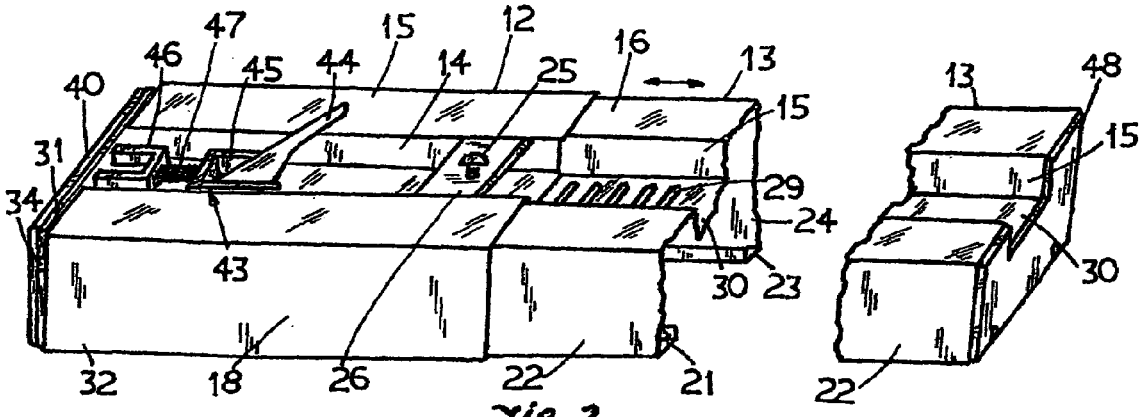
FIG. 3 is an isolated enlarged front and top perspective view of the shell housing of the portable window blind of the present invention.
Figure 4:
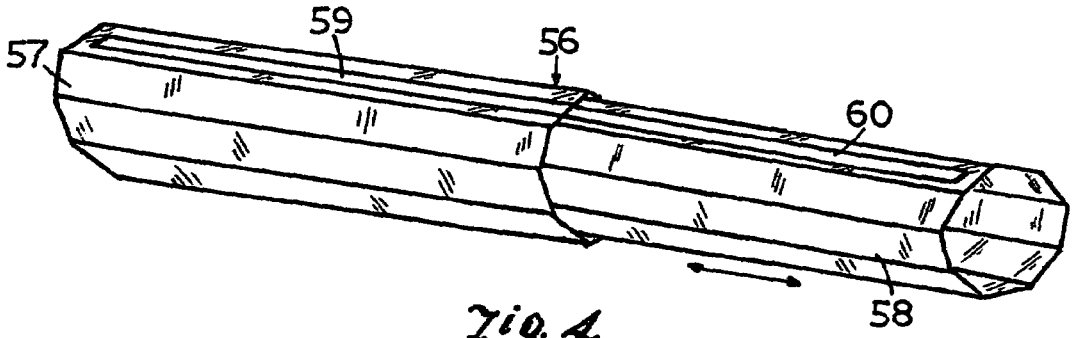
FIG. 4 is an isolated enlarged front and top perspective view of the telescopic winding core for the blind panels of the window blind.
Figure 5:
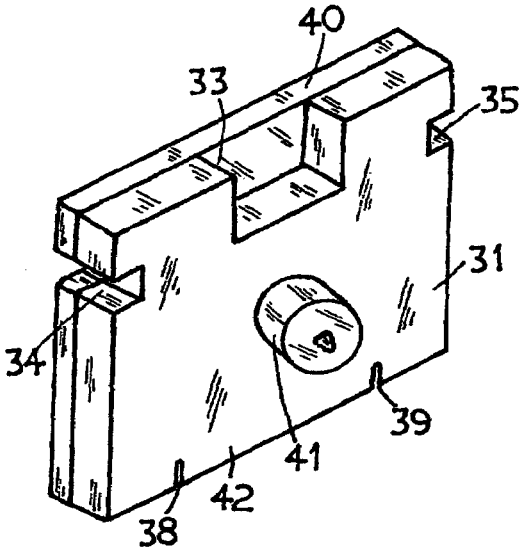
FIG. 5 is an isolated enlarged side and top perspective view of the slidable end plate of the window blind according to the present invention.
Figure 6:
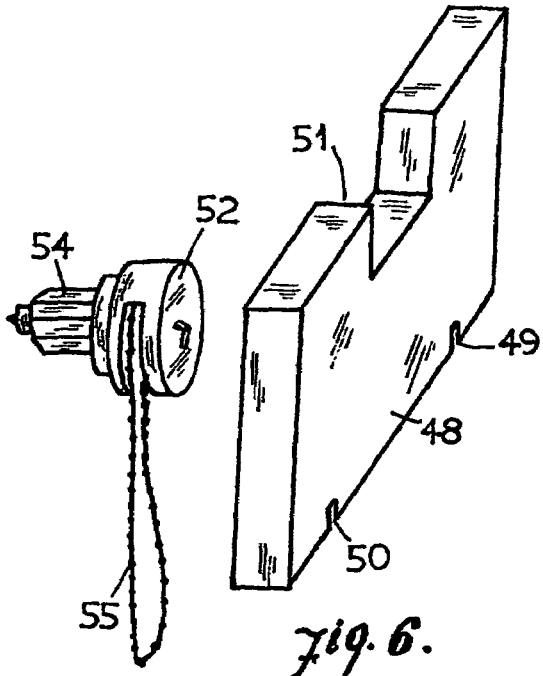
FIG. 6 is an isolated enlarged side and top perspective view of the fixed end plate and the winding device of the window blind according to the present invention.
Figure 7:
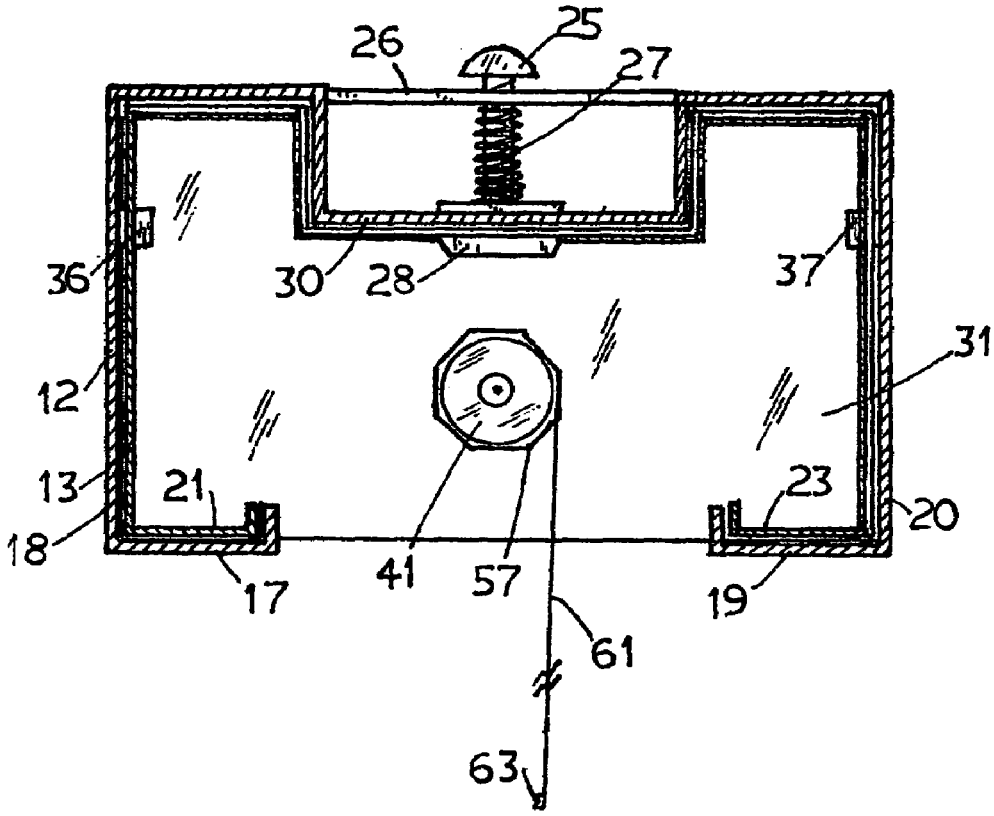
FIG. 7 is a cross sectional right side view of the shell housing of the window blind adjacent to the locking pin.
Figure 8:
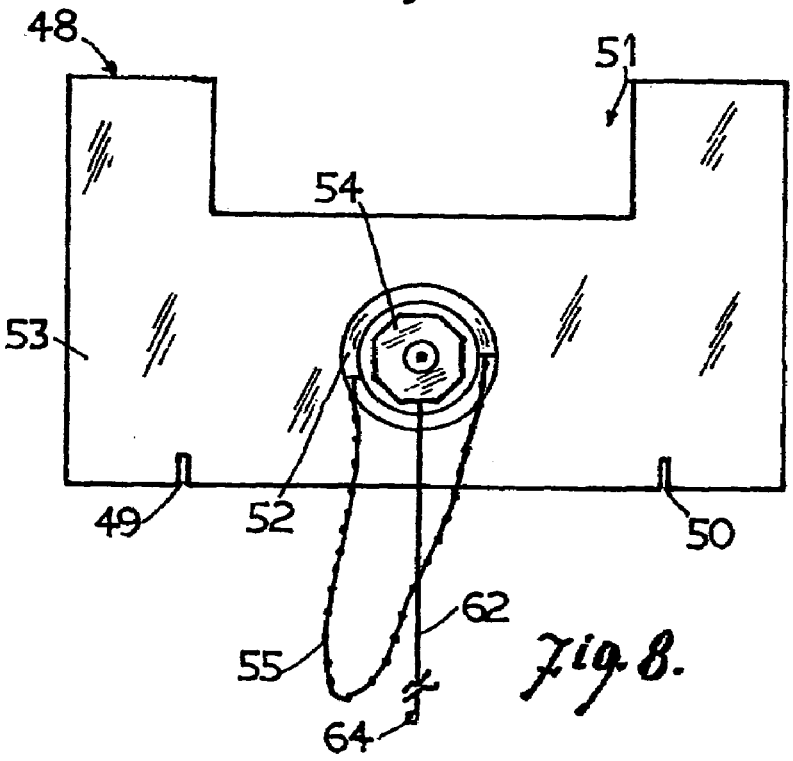
FIG. 8 is a left side view of the second end plate of the window blind.

With reference to the drawings in which like reference numerals designate corresponding parts in the several views, the window blind 10 of the present invention has an elongated shell housing 11 consisting of at least two sections 12 and 13 having generally inverted U-shaped cross section slidably engaged with one another. As shown in the exemplary embodiment, the left section 12 has slightly larger cross section dimensions than the right section 13 such that the latter is slidably insertable within the left section 12. An inverted U-shaped channel 14 is formed in the top panel 15 of the left section 12 and a similar inverted U-shaped channel 15 is formed in the top panel 16 of the right section 13. An inwardly folded lower edge 17 having a L-shaped cross section is formed at one side wall 18 of the left section 12 and a similar inwardly folded lower edge 19 is formed at the other side wall 20. Similarly an L-shaped inwardly folded lower edge 21 is formed at one side wall 22 of the right section 13 and a similar L-shaped inwardly folded lower edge 23 is formed in the other side wall 24 of the right section 13. A locking pin 25 is slidably mounted vertically on a mounting plate 26 extending across the inverted U-shaped channel 14 of the left section 12. The locking pin 25 may be operated to secure the left section 12 and the right section 13 at a selected engaged position to retain the overall length of the shell housing 11 in a selected length. As shown in the exemplary embodiment, the locking pin 25 may be biassed by a spring 27 and a downwardly extending locking plate 28 may be provided at the lower end of the locking pin 25. A plurality of detent slots 29 are formed at the bottom panel 26 of the inverted U-shaped channel 15 of the right section 13. The detent slots 29 extend in a transverse manner across the bottom panel 30 of the right section 13 and having dimensions for receiving the locking plate 28 to be inserted therein for retaining the shell housing ii in the selected length. The spring 27 maintains the locking plate 28 in the pushed down position so that for adjusting the length of the shell housing 11, the locking pin 25 is pulled upward while the shell sections 12 and 13 are slidably adjusted to the selected length and the locking plate 28 will engage with the detent slot 29 to lock the shell housing 11 at that selected length. Alternatively, the locking pin 25 may be in the form of a bolt threadingly mounted on the mounting plate 26, and it may be adjusted by turning it to raise or lower the locking plate 28 to disengage or engage with the detent slot 29 selectively.

A slidable end plate 31 having a shape and dimensions similar to the cross sectional shape and inner cross sectional dimensions of the left section 12 is slidably mounted at the end portion 32 of the left section 12. The slidable end plate 31 has an inverted U-shaped cut out 33 slightly larger in dimensions than the inverted U-shaped channel 14 of the left section 12. Two slots 34 and 35 are formed on the upper side edges of the end plate 31. These slots 34 and 35 are slidably engageable with two ridges 36 and 37 formed on the inner side walls of the left section 12. Two vertical slots 38 and 39 are formed at the lower edge of the end plate 31, which are slidably engageable with the L-shaped inward folded lower edges 17 and 19 respectively of the left section 11. The engagement of the side slots 34 and 35 with the inner ridges 36 and 37, and the vertical slots 38 and 39 engaged with the L-shaped folded lower edges 17 and 19 ensure the end plate 31 to slide in an upright manner relative to the end portion of the left section 12. A wedging pad 40 is mounted on the outer surface of the end plate 31. The wedging pad 40 is preferably made of a resilient material such as rubber. A round support 41 is mounted at a center location on the inner surface 42 of the end plate 31.

A wedging device 43 is pivotally mounted in the end portion of the inverted U-shaped channel 14 of the left section 12. The wedging device 43 consists of a pivot handle 44 pivotally mounted to the inner side walls of the U-shaped channel 14. The pivot handle 44 is mounted to a bifurcated bracket 45 which is connected to a second bifurcated bracket 46 by a spring biassed rod 47. The second bifurcated bracket 46 is mounted to the wedging pad 40. The pivot handle 44 thus may be operated to push and lock the wedging pad 40 to an outward position of the end of the left section 11 when the handle 44 is pushed downwards to lie under the inverted U-shaped channel 14 of the left section 11. A retainer (not shown) such as a hook or a ratchet detent may be provided in the U-shaped channel 14 for retaining the handle 44 in the downward position so that it is not visible from the from of the blind.

Similarly, a second end plate 48 having a shape and dimensions similar to the cross sectional shape and inner dimensions of the right section 13 is fixedly mounted in the end portion of the right section 13. The second end plate 48 has two vertical slots 49 and 50 formed in its lower edge and a U-shaped cut out 51 formed at its upper edge. The vertical slots 49 and 50 are engageable with the inwardly folded lower edges 21 and 23 and the cut out 51 is engageable with the U-shaped channel 15 of the right section 13 for securely mounting it in place within the end portion of the right section 13. A rolling device 52 is mounted at a center position on the inner surface 53 of the end plate 48. The rolling device 52 has a rotary shaft 54 extending in a canti-lever manner and it may be rotated by pulling a pull chain 55. The rotary shaft 54 has a multi-sided cross sectional shape. An eight-sided shape is shown in the exemplary embodiment.

A telescopic winding core 56 consisting of at least two core sections 57 and 58 slidably engaged with one another. The right core section 58 has a multi-sided cross sectional shape and size as the rotary shaft 54 on the end plate 48. In the exemplary embodiment, the core sections and the rotary shaft 54 are shown with an octagonal shape. The left core section 57 has an inner diameter slightly larger than the diameter of the round support 41 on the slidable end plate 42 so that the winding core 56 may be extended and mounted between the end plates 41 and 48 and be rotated by the rotary shaft 54 with the operation of the pull chain 55.

An elongated slot 59 is formed in one side of the left core section 57, and a similar elongated slot 60 is formed in a corresponding side of the right core section 58. The two elongated slot 59 and 60 are aligned and communicative with one another.

A first window blind panel 61 has a top end therein attached to the outer surface of the left core section 57 such as by adhesive or mechanical means such as a plurality of mounting pins. A second window blind panel 62 is mounted to the right core section 58 with its upper end inserted within the elongated slot 60. The first window blind panel 61 and second window blind panel 62 are positioned in a staggered manner relative to one another with a right side portion of the first window blind panel 61 overlapping the left side portion of the second window blind panel 62 even when the winding core 56 is at its most extended length. When the right core section 58 is slidably inserted into the left core section 57, the left side edge portion of the second window blind panel 62 will slide into the elongated slot 59 of the left core section 57.

The window blind panels 61 and 62 may be made of a common window blind fabric material, and two weight rods 63 and 64 may be mounted at their lower ends for maintaining them in a taut and flat manner when they extend fully downwards to cover the window opening as best shown in FIG. 1. The pull chain 55 may be operated to roll the panels 61 and 62 onto the core sections 57 and 58 for opening the blind.

The blind may be removably mounted in a window frame by first extending and adjusting the shell housing sections 12 and 13 so that the shell housing 11 has a length approximately equal to the width of the window frame with both the end plates 31 and 48 in contact with the two sides of the window frame. The shell housing 11 is then placed in the desirable position at a selected height level; and the pivotal handle 44 of the wedging device 43 is then operated to urge the end plate 31 against the adjacent side of the window frame so that the end plate 31 and the end plate 48, in turn, would press tightly against the two sides of the window frame to secure the shell housing 11 at the selected position. The pivotal handle 44 will then be retained in the downward position by the retaining means so that it is not visible from the front of the blind. The telescopic winding core 56 may then be mounted between the round support 41 and the rotary shaft 54 within the shell housing 11 by first unwinding the panels 61 and 62 from the telescopic winding core 56 and then adjusting the length of the core to mount it onto the round support 41 and rotary shaft 54. Once mounted, the pull chain 55 may then be operated to wind the panels 61 and 62 onto the winding core 56 to the selected length. The window blind 10 may be readily removed from the window frame in the reverse order, and no damage or marking would be formed in the window frame and/or the neighboring wall area after the window blind has been removed.

Various modifications can be made without departing from the spirit of this invention or the scope of the appended claims. The embodiments of the invention set forth in this disclosure are given as examples and are in no way final or binding. In view of the above, it will be seen that several objects of the invention are achieved and other advantages are obtained. As many changes could be made in the above construction and methods without departing from the scope of the invention, it is intended that all matter contained in the above description shall be interpreted as illustrative and not in a limiting sense.

What I claim is:

1. A portable roll up window blind removably mountable in a window frame comprising, a shell housing having a generally inverted U-shaped cross section and including at least two shell sections slidably engaged with one another and adjustable for setting said shell housing to a selected length, a locking means mounted on one of said shell sections and operative for maintaining said shell housing at said selected length, a first end plate mounted within a first free end of said shell housing, said first end plate being movable slidably relative to said first free end of said shell housing, a second end plate fixedly mounted at a second free end of said shell housing and being located opposite to said first free end of said shell housing, a wedging means mounted on one of said shell section and operative for moving said first end plate slidably relative to said first free end of said shell housing for pressing said first end plate against a side wall of said window frame thereby said first end plate and said second end plate cooperate with one another for pressing tightly against opposite side walls of said window frame for maintaining said shell housing securely and removably mounted at a selected height level inside said window frame, a round support pin mounted at a center position on an inner surface of said first end plate, a winding means mounted at a center position on an inner surface of said second end plate, said winding means having a rotary shaft extending in a cantilever manner and located directly opposite to said round support pin, said rotary shaft having a free end portion having a multi-sided cross sectional shape, said winding means having a pull chain operative for rotating said rotary shaft, a telescoping winding core including a first elongated core section and a second elongated core section slidably engaged with one another and being adjustable for setting said winding core to a selected length for locating between said first end plate and said second end plate within said shell housing, and said first core section having a hollow end portion having cross sectional shape and dimensions equal to said multi-sided cross sectional shape and dimensions of said free end portion of said rotary shaft, said second core section having a hollow end portion rotatably engaged with said round support pin, a first elongated slot formed in one longitudinal side wall of said first core section, and a second elongated slot formed in one longitudinal side wall of said second core section, said first elongated slot and said second elongated slot being aligned with one another, a first window blind panel having a top edge attached to a longitudinal external surface of said second core section, a second window blind panel having a top edge attached to a longitudinal external surface of said first core section and a vertical edge portion of said second window blind panel being extensible within said second elongated slot of said second core section.

2. A portable roll up window blind according to claim 1 including a first weight rod mounted at a lower end of said first window blind panel and a second weight rod mounted at a lower end of said second window blind panel.

3. A portable roll up window blind according to claim 2 wherein said locking means is a locking pin mounted on said first shell section and being operative for causing a locking plate located at a lower end therein to engage with a selected detent slot of a plurality of detent slots formed in said second shell section for retaining said shell housing in a selected length.

4. A portable roll up window blind according to claim 3 wherein said wedging means includes a bracket mounted to said first end plate and having a pivot arm pivotally mounted on said first section of said shell housing, said pivotal arm being operative for slidably pressing said first end plate against said adjacent side wall of said window frame whereby said first end plate and said second end plate cooperate with one another for maintaining said shell housing securely mounted at said selected position within said window frame.

5. A portable roll up window blind according to claim 4 including a first pad made of a resilient material and said first pad being mounted on an outer surface of said slidable first end plate.

6. A portable roll up window blind according to claim 5 wherein said first window blind panel and said second window blind panel are made of a window blind fabric material.

7. A portable roll up window blind according to claim 6 including two slots formed at two opposite vertical sides of said slidable first end plate and said first pad, said slots being slidably engageable with two horizontal ridges formed on inner surfaces of two opposite side walls of said first free end of said shell housing.

8. A portable roll up window blind according to claim 7 wherein said first free end of said shell housing includes an L-shaped inwardly folded portion formed at a lower edge of opposite side walls therein, and two vertical slots are formed in a spaced manner at a lower edge of said slidable first end plate, said vertical slots being slidably engageable with said L-shaped inwardly folded portion at said opposite side walls.

9. A portable roll up window blind according to claim 8 wherein said multi-sided cross sectional shape of said first elongated core section and said second elongated core section of said winding core and said rotary shaft is an octagonal shape.

* * * * *